US008931996B2

(12) United States Patent
Friesen et al.

(10) Patent No.: US 8,931,996 B2
(45) Date of Patent: Jan. 13, 2015

(54) PORTABLE SILO WITH SOLAR POWERED ACTUATORS

(71) Applicant: FB Industries Inc., Winkler (CA)

(72) Inventors: Henry Friesen, Winkler (CA); Hank Boschmann, Winkler (CA)

(73) Assignee: FB Industries Inc., Winkler, Manitoba (CA)

( * ) Notice: Subject to any disclaimer, the term of this patent is extended or adjusted under 35 U.S.C. 154(b) by 25 days.

(21) Appl. No.: 13/632,424

(22) Filed: Oct. 1, 2012

(65) Prior Publication Data

US 2014/0093339 A1 Apr. 3, 2014

(51) Int. Cl.

| | |
|---|---|
| ***B65D 88/62*** | (2006.01) |
| ***B65D 88/54*** | (2006.01) |
| ***B65D 88/30*** | (2006.01) |
| ***B65D 90/00*** | (2006.01) |
| ***B65D 90/62*** | (2006.01) |
| ***B65D 90/66*** | (2006.01) |

(52) U.S. Cl.

CPC ..... *B65D 88/54* (2013.01); *B65D 2590/664* (2013.01); *B65D 88/30* (2013.01); *B65D 90/00* (2013.01); *B65D 90/623* (2013.01); *B65D 90/66* (2013.01)

USPC ..... 414/288

(58) Field of Classification Search

CPC .... B65D 88/30; B65D 79/02; B65D 2203/00; B65D 55/026; B65G 41/002; E01C 19/10; B62D 3/04; B60P 1/16; B60P 1/6454; B60P 3/122; A01D 90/08

USPC ..... 414/425, 469, 288; 206/459.1

See application file for complete search history.

(56) References Cited

U.S. PATENT DOCUMENTS

| | | | | |
|---|---|---|---|---|
| 5,339,996 | A * | 8/1994 | Dubbert et al. | 222/185.1 |
| 6,323,782 | B1 * | 11/2001 | Stephens et al. | 340/10.31 |

FOREIGN PATENT DOCUMENTS

| | | |
|---|---|---|
| CA | 2600216 | 3/2009 |
| CA | 2732170 | 8/2012 |

* cited by examiner

*Primary Examiner* — Saul Rodriguez
*Assistant Examiner* — Emery Hassan
(74) *Attorney, Agent, or Firm* — Adrian D. Battison; Ade & Company Inc.

(57) ABSTRACT

A portable storage silo comprising a tank has a peripheral wall, a top wall and a bottom wall. There is provided a filling opening at or adjacent a top of the tank and a discharge opening at or adjacent a bottom of the tank. A support assembly for holding the tank with the bottom wall raised from the ground such that the discharge opening is raised for discharge into a receptacle at the ground. The support assembly includes a base for resting on the ground. The base including a plurality of arms connected to the base and located at spaced positions around the base. The discharge opening has an electrically actuated gate arrangement. The filling opening has an electrically actuated lid. The actuators at the discharge opening and the filling opening are solar powered.

4 Claims, 5 Drawing Sheets

39
41
43
45
51
53
55
57
59
61

PORTABLE SILO WITH SOLAR POWERED ACTUATORS

This invention relates to a portable silo for storing particulate material which is portable so that it can be moved to a temporary location and includes solar powered actuators at a discharge chute and silo lid.

BACKGROUND OF THE INVENTION

In Canadian application Serial No: 2,600,216 of Herman published Mar. 4, 2009 is disclosed a silo or tank which is cylindrical and stands up from a base to a raised upper end at which it can be filled. Such tanks can hold up to 250 tons of a particulate material such as sand. The main point concerning the Herman tank is that it is portable and includes a coupling for attachment to a trailer so that it can be moved to a temporary location.

Often such tanks are mounted on rig mats at a work site or on other unstable base support. As the mounting is temporary, there is no possibility for foundation work to hold the tank stable.

As such tanks contain large amounts of material they apply significant force to the base on which they stand and also the consequences of instability leading to toppling are severe.

In Canadian Application 2,732,170 published Aug. 16, 2012 is disclosed a silo of this type where there is provided a mounting base which better supports the structure.

Another issue is that the silo is often required to be located at remote positions where there are little facilities.

SUMMARY OF THE INVENTION

It is one object of the present invention to provide a silo of this type which is modified for improved operation.

According to one aspect of the invention there is provided a portable storage silo comprising:

a tank having a peripheral wall, a top wall and a bottom wall;

a filling opening at or adjacent a top of the tank;

a discharge opening at or adjacent a bottom of the tank;

a support assembly for holding the tank with the bottom wall raised from the ground such that the discharge opening is raised for discharge into a receptacle at the ground;

the support assembly including a base for resting on the ground;

wherein the discharge opening has an electrically actuated gate arrangement;

wherein the filling opening has an electrically actuated lid;

the actuators at the discharge opening and the filling opening are operated with power from solar panels.

Preferably the solar panels which are mounted on the silo on one side adjacent an upper end of the silo.

Preferably the battery pack charged by the solar panels where the battery pack is located at the base underneath the silo.

Preferably there is provided a manual override lever on the discharge opening.

BRIEF DESCRIPTION OF THE DRAWINGS

One embodiment of the invention will now be described in conjunction with the accompanying drawings in which.

In the drawings like characters of reference indicate corresponding parts in the different figures.

DETAILED DESCRIPTION

Figure 1:
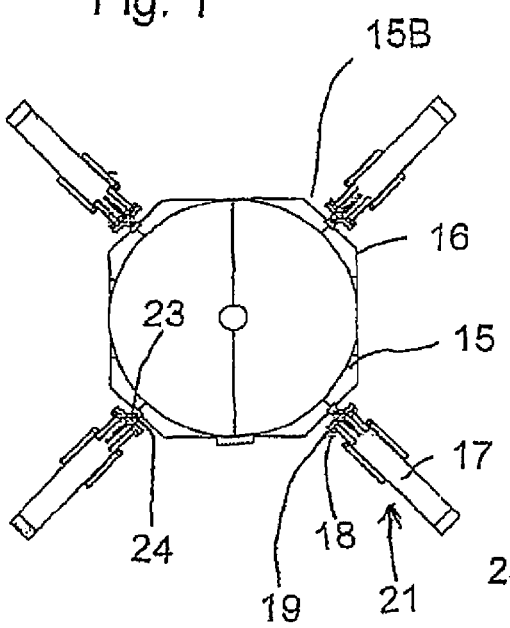
FIG. 1 is a top plan view of a silo according to the present invention with the stabilization arms extended and radial.

The portable storage silo includes a cylindrical tank 10 having a peripheral wall 11, a top wall 12 with a filler opening 12A and a bottom wall 13 with a discharge opening at or adjacent a bottom of the tank.

The tank has a height greater than 30 feet and preferably greater than 40 feet and a diameter less than 15 feet and preferably of the order of thirteen feet which allows it to be portable on a flat bed trailer which is the maximum allowing road transport.

A support assembly 14 is provided for holding the tank with the bottom wall raised from the ground such that the discharge opening is raised for discharge into a receptacle at the ground. Thus when standing it is relatively unstable due to the high weight contained and the great height relative to width.

The support assembly 14 includes a base 15 for resting on the ground. The base defines a ring 15 with an outer peripheral edge 16 with a transverse dimension approximately equal to that of the tank so that is also transportable as part of the same dimension.

The base includes a plurality of upstanding support legs 40 extending from the ring 15 at the ground to the peripheral wall of the tank to support the tank raised from the ring. The support legs are connected to and extend along the peripheral wall of the tank to a position adjacent the top of the tank to provide additional connection to and structural strength for the tank.

The ring carries a plurality, preferably four, of stabilizer arms 17 connected to the base and located at spaced positions around the base. The ring has four diagonal side edges 15B and each stabilizer arm is attached at a respective one of the diagonal side edges so as to be spaced at 90 degrees around the periphery of the tank.

Figure 2:
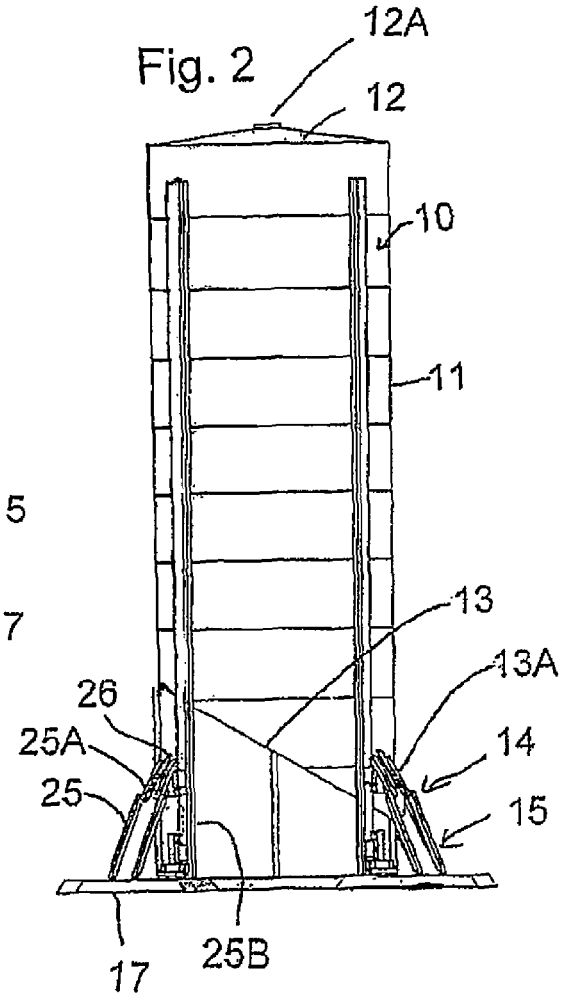
FIG. 2 is a side elevational view of the tank of FIG. 1 showing the stabilization arms extended.
Figure 3:
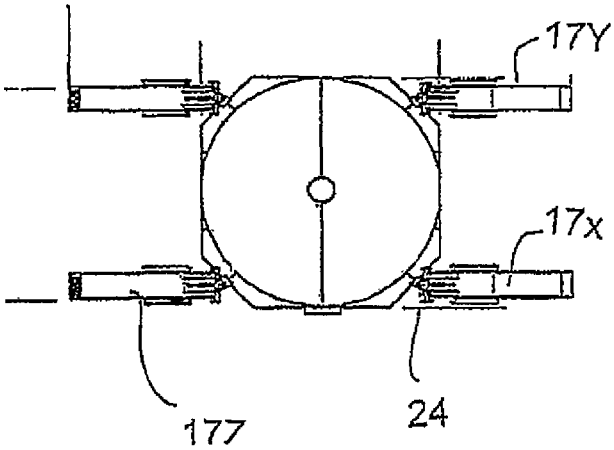
FIG. 3 is a top plan view of the tank of FIG. 1 showing the stabilization arms extended and parallel.
Figure 4:
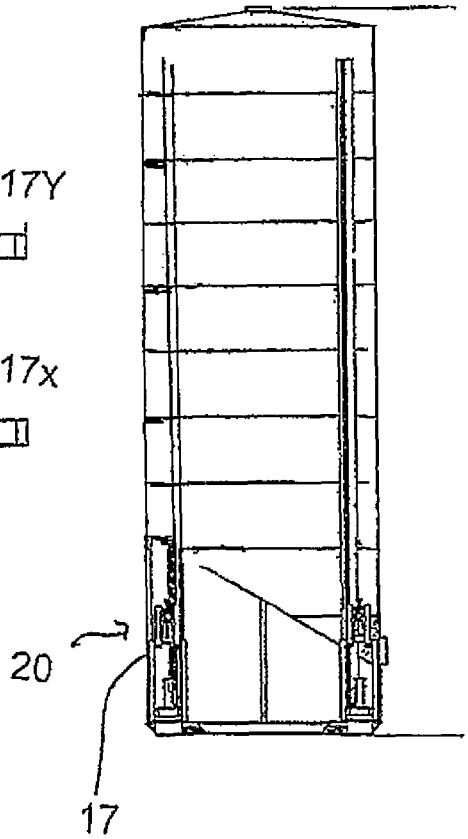
FIG. 4 is a side elevational view of the tank of FIG. 1 showing the stabilization arms retracted.
Figure 5:
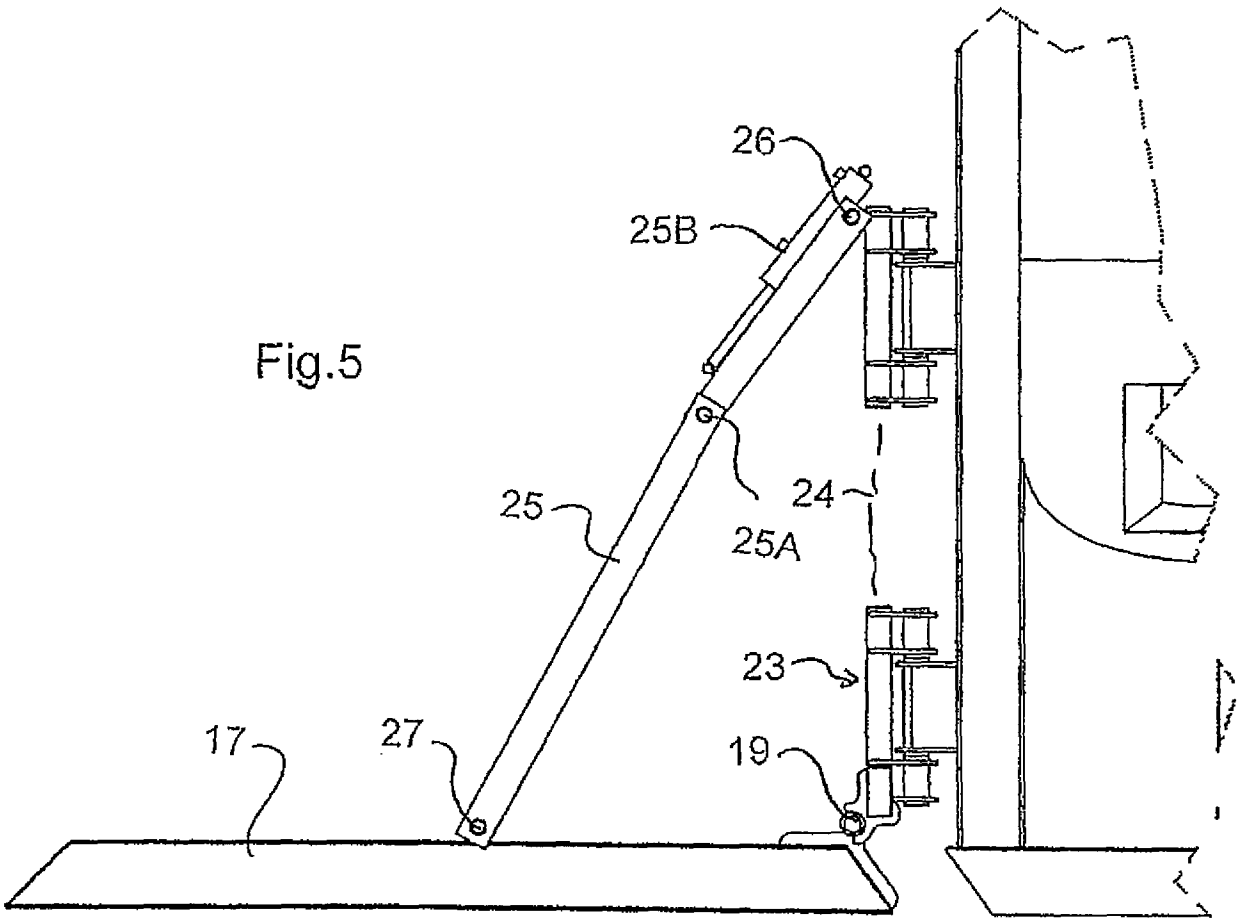
FIG. 5 is an isometric view of the tank of FIG. 1 showing on enlarged scale one stabilization arm.

Each stabilizer arms is mounted on a pivot bracket 18 so that it is movable by pivotal movement about a horizontal axis 19 into a first retracted position 20 shown in FIG. 4 where it is raised from the base vertically upwardly so as to lie in the common periphery of the base and tank for transport. Each stabilizer arms is movable to a second extended position 21 shown in FIG. 2 extending outwardly to respective side of the base for stabilizing the base against tilting. Each arm is also mounted on a second pivot bracket 23 so as to be movable about an upstanding axis 24 at the base so as to move the arm so that its angle around the base is adjustable. Thus each arm is movable from a position in which the arm is radial to a central vertical axis of the base as shown in FIG. 1 and is movable through an angle of 90 degrees from a first position in the arm 17X is parallel to an arm 17Y on one side as shown in FIG. 3 to a second position in which it is parallel to an arm 17Z on the other side.

Each arm includes a brace 25 extending from the base at a pivot point 26 to a bottom pivot point 17 at the arm 17, the brace being movable from a position lifting the arm to the retracted position shown in FIG. 4 to the position extending downwardly and outwardly to locate the arm in the extended position shown in FIG. 1. In order to effect this motion, the brace includes an elbow 25A allowing it to be folded at the elbow by an actuator or hydraulic cylinder 25B extending along the brace from the upper end to a crank (not shown) at the elbow for driving folding of the brace to effect movement of the arm. The upper end of the brace is also mounted on pivot bracket 23A aligned with the bracket 23 and defining the common axis 24 therewith so that both the brace and the arm 17 pivot around the axis 24 to provide the angular adjustment of the arm.

Figure 6:
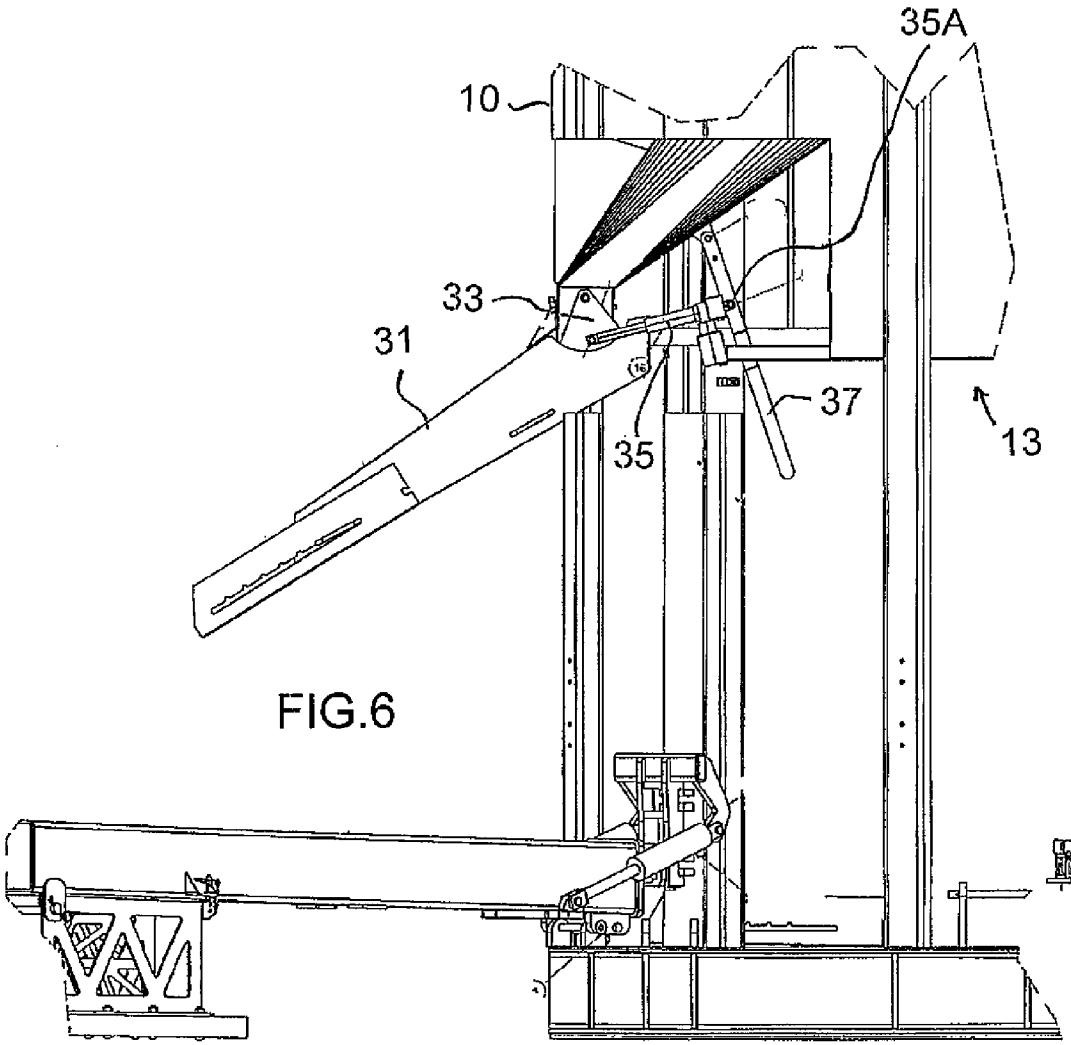
FIG. 6 is a side elevational view having a cut out section for illustration of the bottom discharge assembly of the silo according to the present invention.

As illustrated in FIG. 6, a discharge chute 31 is located at a bottom end of the silo 10. The discharge chute is arranged to allow the contents of the silo be emptied into a transport vehicle. The chute extends beyond the outer wall of the silo for access by a transport vehicle. Connecting the chute to the silo is a clam shell gate 33. The clam shell gate can be opened such that the contents of the silo can be released down the chute 31 to a transport vehicle. The clam shell gate 33 has an electrically controlled actuator 35 arranged to electronically open and close the gate. A manual gate override lever 37 is attached to an end 35A of the actuator 35 so that pivotal movement of the lever 27 is arranged such that the gate can be manually opened and closed.

Figure 7:
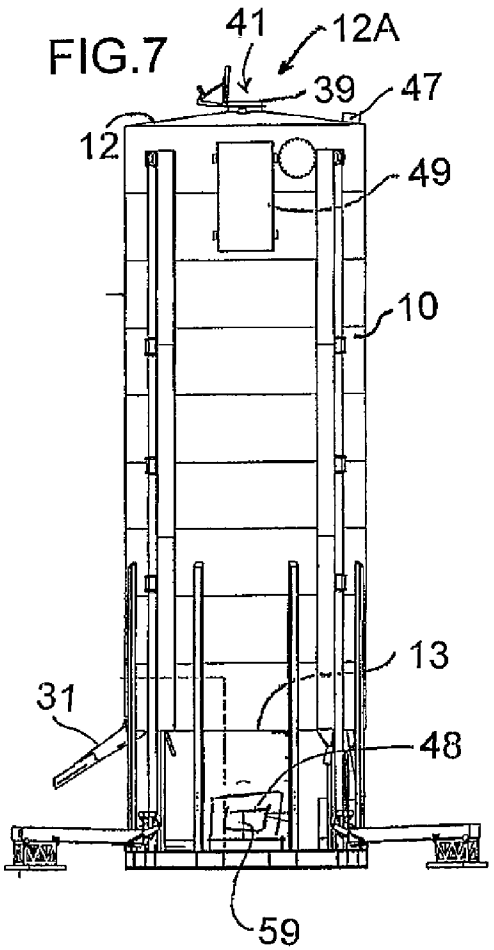
FIG. 7 is a side elevational view of the silo according to the present invention of the silo according to the present invention.
Figures 8, 9, 10:
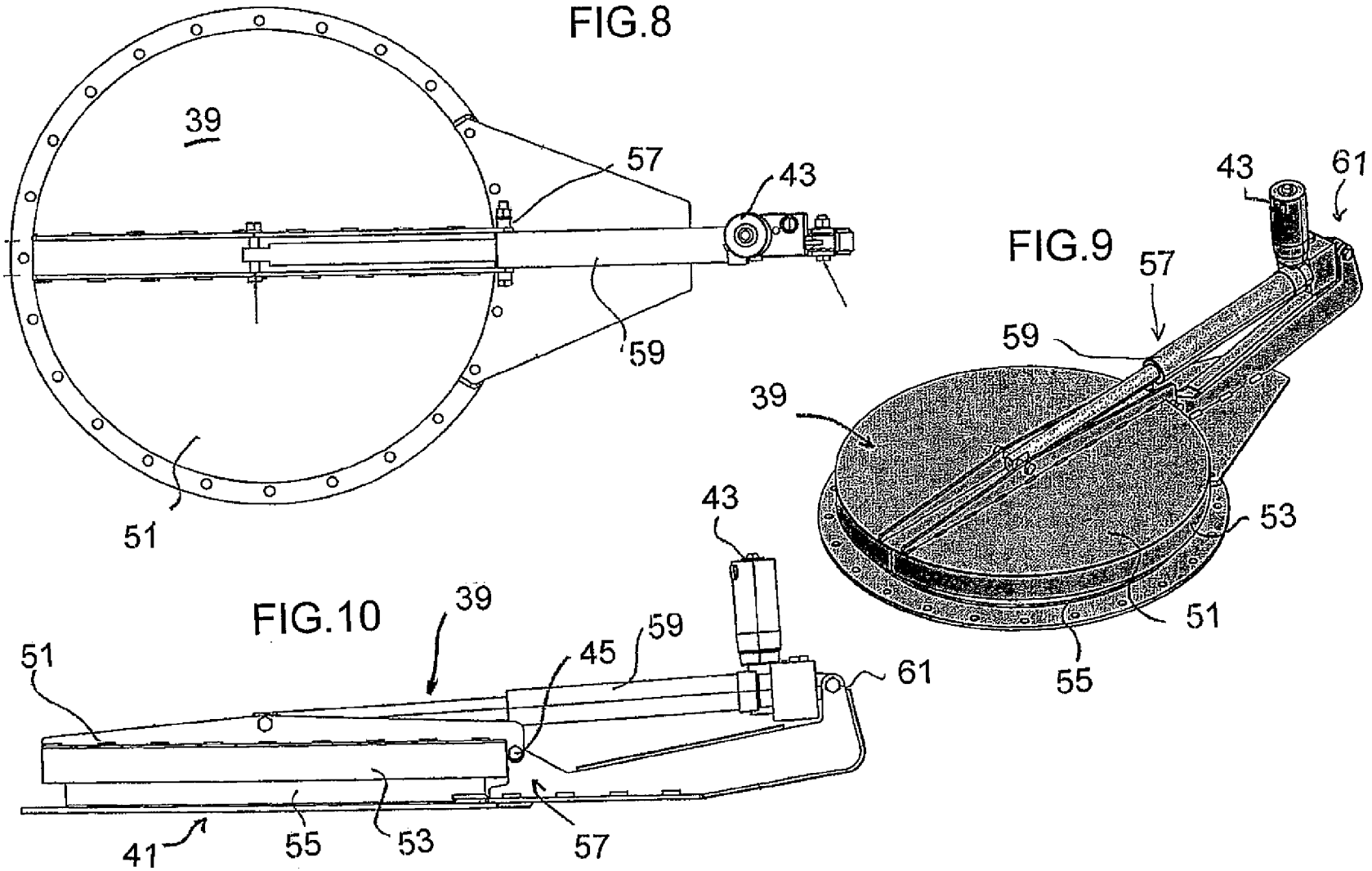
FIG. 8 is a top plan view of the top opening closure member of the silo according to the present invention.
FIG. 9 is an isometric view of the top opening closure member of the silo according to the present invention.
FIG. 10 is a side elevational view of the top opening closure member of the silo according to the present invention.

On a top end of the silo, as illustrated in FIGS. 7, 8 and 9, is an electrically controlled silo lid 39. The lid 39 is a circular body with downturned side flange and is arranged to cover an opening 41 on the top of the silo where the contents of the silo are loaded by an auger or the like. An electric actuator 43 is arranged to open and close the lid by raising the lid on a pivot 45. The lid is located at a centralize location on the top end of the silo.

Each of the actuators in the chute and top opening are powered by a battery pack 48 located at the base underneath the silo, which is charged by a solar panel arrangement 49 mounted on the side wall of the silo adjacent the top end. The battery pack is charged when solar power is available and this power is arranged to be sufficient to drive the actuators of the silo. The operation of the actuators and the control of the charging system is controlled by a control panel 59 located at the battery pack on the base. The control unit communicates by cables to switches 47 at the actuators.

The silo lid has a circular shaped panel 51 having downwardly extending flanges 53 arranged to enclose on the opening. The opening has upwardly extending flanges 55 arranged to fit within the flanges of the lid.

The lid is pivoted at a pivot point 57 located at an end of the lid. The actuator has a elongated arm 59 extending from a hinged mount 61 directly behind the pivot on the lid such that retraction of a cylinder within the arm pivots the lid up. Extension of the cylinder closes the lid.

Since various modifications can be made in my invention as herein above described, and many apparently widely different embodiments of same made within the spirit and scope of the claims without department from such spirit and scope, it is intended that all matter contained in the accompanying specification shall be interpreted as illustrative only and not in a limiting sense.

The invention claimed is:

1. A portable storage silo for particulate material comprising:

a tank having a peripheral wall defining a cylindrical outer periphery surrounding a longitudinal axis of the tank, a top wall and a bottom wall;

the cylindrical outer periphery having an outer diameter less than 15 feet so as to allow the tank to be portable on a flat bed trailer;

the tank having height of at least 30 feet;

a filling opening for the particulate material mounted in a top wall of the tank;

a discharge opening for the particulate material at a bottom of the tank;

a support assembly for holding the tank with the bottom wall raised from the ground such that the discharge opening is raised for discharge into a receptacle at the ground;

the support assembly including a base arranged for resting on the ground to support the tank standing upwardly from the ground;

the base being fixed by a plurality of upstanding legs of the base relative to the tank so that the base is fixed in a radial plane of the axis;

the base and the legs thereof defining an outer peripheral edge with transverse dimensions in all direction transverse to the tank which are substantially equal to the diameter of the circular outer periphery and so that the base is also transportable with the tank;

the base including at least four stabilizer arms connected to the base and located at spaced positions around the base;

each stabilizer arm being movable from a first retracted position in which the stabilizer arm is located inside the circular outer periphery for transport with the tank to a second extended position in which the stabilizer arm extends outwardly to respective side of the base for engaging the ground outwardly of the base while the base sits on the around for stabilizing the base against tilting;

a discharge transfer device mounted underneath the discharge opening for transfer of the particulate material from the discharge opening to a loading position outside the legs of the base;

wherein the discharge opening has a gate arrangement operable to prevent material from the discharge opening to be transferred to the loading position, the gate arrangement being operable by a first electric actuator;

a lid pivotal by a crank on the top wall, the crank being operable by a second electric actuator;

at least one solar panel mounted on the silo;

a battery pack arranged to be charged by said at least one solar panel;

wherein the first and second actuators are operated with power from the battery pack provided from said at least one solar panel.

2. The storage silo according to claim 1 wherein the solar panels are mounted on the silo on one side of the tank adjacent an upper end of the tank.

3. The storage silo according to claim 1 wherein the battery pack is located at the base underneath the tank.

4. The storage silo according to claim 1 wherein there is provided a manual override lever on the gate at the discharge opening.

* * * * *